US009995010B2

(12) United States Patent
Haydu

(10) Patent No.: US 9,995,010 B2
(45) **Date of Patent: *Jun. 12, 2018**

(54) WATERPROOF EXPANSION JOINT

(71) Applicant: VERSAFLEX, INC., Riverside, CA (US)

(72) Inventor: Joseph Haydu, Riverside, CA (US)

(73) Assignee: Versaflex, Inc., Riverside, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/989,463

(22) Filed: Jan. 6, 2016

(65) Prior Publication Data

US 2016/0115657 A1 Apr. 28, 2016

Related U.S. Application Data

(60) Division of application No. 14/478,986, filed on Sep. 5, 2014, now Pat. No. 9,234,321, which is a continuation of application No. 13/959,463, filed on Aug. 5, 2013, now Pat. No. 8,826,481, which is a continuation-in-part of application No. 13/480,310, filed on May 24, 2012, now Pat. No. 8,499,394.

(60) Provisional application No. 61/552,284, filed on Oct. 27, 2011.

(51) Int. Cl.

| | |
|---|---|
| ***E01D 19/00*** | (2006.01) |
| ***E01D 19/06*** | (2006.01) |
| ***E01C 11/02*** | (2006.01) |
| ***E01D 19/08*** | (2006.01) |
| *E01C 11/04* | (2006.01) |

(52) U.S. Cl.
CPC ..... *E01D 19/005* (2013.01); *E01C 11/02* (2013.01); *E01D 19/06* (2013.01); *E01D 19/083* (2013.01); *E01C 11/04* (2013.01); *E01D 19/065* (2013.01)

(58) Field of Classification Search
CPC ..... E01C 11/02; E01C 11/04; E01D 19/06; E01D 19/065
USPC ..... 14/73.1, 73.5; 404/56, 68
See application file for complete search history.

(56) References Cited

U.S. PATENT DOCUMENTS 3,696,575 A * 10/1972 Armstrong ..... E04B 1/6804 52/288.1
3,745,726 A * 7/1973 Thom ..... E04B 1/6804 404/47
4,129,967 A * 12/1978 Barlow ..... E01D 19/06 404/69
4,279,533 A * 7/1981 Peterson ..... E01D 19/067 404/68
4,307,974 A * 12/1981 George ..... E01D 19/06 14/73.1
4,784,516 A * 11/1988 Cox ..... E01C 11/10 14/73.1

(Continued)

*Primary Examiner* — Gary S Hartmann
(74) *Attorney, Agent, or Firm* — Knobbe, Martens, Olson & Bear, LLP

(57) ABSTRACT

A waterproof expansion joint comprises a ballast protection plate and at least one locating device configured to retain the ballast protection plate over a deck joint. A flexible sealing member located below the ballast protection plate can include at least one flange portion and at least one expansion feature. Each expansion feature can include a shape preformed into the flexible sealing member extending downward into the deck joint and configured to deflect, enabling variation in the width of the flexible sealing member to match the width of the deck joint.

16 Claims, 12 Drawing Sheets

(56) References Cited

U.S. PATENT DOCUMENTS

| | | | | | |
|---|---|---|---|---|---|
| 4,866,898 | A * | 9/1989 | LaRoche | E04B 1/6804 | 52/396.01 |
| 5,171,100 | A * | 12/1992 | Bergstedt | E01C 11/106 | 403/225 |
| 5,197,250 | A * | 3/1993 | Kramer | E01D 19/06 | 404/65 |
| 5,365,713 | A * | 11/1994 | Nicholas | E04B 1/681 | 52/396.03 |
| 6,112,488 | A * | 9/2000 | Olson | E04B 1/948 | 52/167.1 |
| 6,115,980 | A * | 9/2000 | Knak | E04B 1/6804 | 52/396.04 |
| 6,619,879 | B1 * | 9/2003 | Scuero | E02B 3/16 | 404/72 |
| 7,856,781 | B2 * | 12/2010 | Hilburn, Jr. | E04B 1/948 | 52/232 |
| 8,499,394 | B1 * | 8/2013 | Haydu | E01D 19/06 | 14/73.1 |
| 8,646,235 | B2 * | 2/2014 | Hilburn, Jr. | E04B 1/948 | 52/232 |
| 8,826,481 | B1 * | 9/2014 | Haydu | E01D 19/06 | 14/73.5 |
| 9,234,321 | B2 * | 1/2016 | Haydu | E01D 19/06 | |
| 2004/0083669 | A1 * | 5/2004 | Hilburn | E04B 1/681 | 52/396.04 |

* cited by examiner

WATERPROOF EXPANSION JOINT

CROSS-REFERENCE TO RELATED APPLICATIONS

This application is a divisional of U.S. patent application Ser. No. 14/478,986 entitled "WATERPROOF EXPANSION JOINT", filed Sep. 5, 2014, which is a continuation of U.S. patent application Ser. No. 13/959,463 entitled "WATERPROOF EXPANSION JOINT", filed Aug. 5, 2013, which is a continuation in part of U.S. patent application Ser. No. 13/480,310 entitled "WATERPROOF EXPANSION JOINT", filed May 24, 2012, which claims the priority of U.S. Provisional Application No. 61/552,284 filed Oct. 27, 2011, the entirety of which are hereby incorporated by reference in their entirety.

BACKGROUND OF THE INVENTION

Field of the Invention

This application relates to waterproof expansion joints for railway bridges.

Background of the Related Art

Railway bridges are continually in a state of motion. Expansion and contraction caused by changes in thermal conditions, deflections caused by live loads, and longitudinal forces caused by railway traffic all combine to produce nearly continuous motion in the decks of railway bridges. The most common method of accommodating this movement, and the forces associated with it, is the deck joint. Deck joints—spaces between the girders that make up the deck of the bridge—allow the bridge to experience expansion, contraction, deflection, etc. without damage. Railway bridges are typically covered with ballast, however, requiring some method of sealing the deck joints to be incorporated into the bridge design in order to inhibit the ballast from falling through the deck joints and creating a potentially hazardous situation below the bridge. One method of inhibiting this leakage of ballast is by covering the deck joints with rigid ballast protection plates.

While accommodating the expansion, contraction, displacement, and other movements of bridge decks, deck joints may allow water to pass through, creating potentially hazardous situations under the bridge, including icicles. Ballast protection plates do not typically inhibit the leakage of water through the deck joint. Existing methods of waterproofing deck joints are designed with automobile bridges in mind. Such waterproof joints do not withstand the pressure of ballast and railways.

Therefore, there is a need for waterproof expansion joints that stand up to the stresses of railway bridges and the ballast associated with them while still providing adequate protection from water leakage. Such a waterproof expansion joint will provide the benefits of waterproofing the deck joints without substantially altering the manner in which railway bridges are constructed, for example with ballast protection plates having centering tabs coupled to their bottom face.

SUMMARY OF THE INVENTION

The systems, methods, and devices of the invention each have several aspects, no single one of which is solely responsible for its desirable attributes. Without limiting the scope of the invention, certain features will now be discussed briefly.

In one embodiment, a waterproof expansion joint can include a ballast protection plate with one or more centering tabs. Waterproof receptacles, or T-cups, are used to provide a waterproof layer under the ballast protection plate and around the centering tabs. Sealing tape and a spray-based waterproof membrane are installed with the T-cups. Once the ballast protection plate is placed over the deck joint with centering tabs extending downward into the T-cups, a bond breaker is applied. Finally, a second layer of waterproof membrane is applied to the top of all elements of the waterproof expansion joint.

The T-cups can be made of any suitable material able to withstand the lateral movement of the centering tab contained within. The waterproof membrane can be made of any suitable material able to withstand the extremes of outdoor use, the motion and forces attended in expansion bridges, and the course ballast piled above.

In another embodiment, the waterproof expansion joint for use on a deck joint defined by at least two girders can include a ballast protection plate dimensioned such that when installed over a deck joint the ballast protection plate inhibits ballast from falling into a deck joint, at least one locating device positioned with respect to the ballast protection plate such that the locating device limits lateral movement of the ballast protection plate with respect to the deck joint, a flexible sealing member dimensioned to be installed below the ballast protection plate and span the deck joint, wherein the flexible sealing member comprises at least one flange portion, each flange portion dimensioned to be attached to a girder, wherein the flexible sealing member comprises at least one expansion feature, and wherein the at least one expansion feature comprises a shape preformed into the flexible sealing member, wherein the at least one expansion feature dimensioned such that when installed over a deck joint the expansion feature extends down into the deck joint, and wherein the at least one expansion feature is can deflect, such that the width of the flexible sealing member can be varied depending on the width of the deck joint without compromising the structural integrity or waterproof nature of the flexible sealing member.

In another embodiment a method of waterproofing a deck joint of a bridge can include applying a bridge deck waterproof membrane over a portion of the top surface of at least two girders which define a deck joint, applying an adhesive layer over a portion of the waterproof membrane, installing a flexible sealing member, wherein the flexible sealing member comprises two flange portions, wherein installing a flexible sealing member comprises placing each flange portion on the adhesive layer on each girder, such that each flange portion bonds to each girder, installing a ballast protection plate spanning the deck joint, and installing a pair of locating devices to retain the ballast protection plate from falling into the deck joint, wherein each locating device is installed on the top surface of each girder.

In another embodiment, the waterproof expansion joint for use on a deck joint defined by at least two girders can include a ballast protection plate dimensioned such that when installed over a deck joint the ballast protection plate inhibits ballast from falling into a deck joint, at least one plate end guide positioned with respect to the ballast protection plate such that the plate end guide limits lateral movement of the ballast protection plate with respect to the deck joint, wherein the at least one plate end guide comprises at least one elongate member located on top of the girder and spaced a distance from the edge of the ballast protection plate large enough to allow for variation in the width of the deck joint but not large enough to allow the ballast protection plate to fall through the deck joint.

BRIEF DESCRIPTION OF THE DRAWINGS

Certain embodiments of the disclosure will now be discussed in detail with reference to the following figures. These figures are provided for illustrative purposes only, and the disclosure is not limited to the subject matter illustrated in the figures.

DETAILED DESCRIPTION OF THE PREFERRED EMBODIMENT

Embodiments of the invention will now be described with reference to the accompanying figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 1:
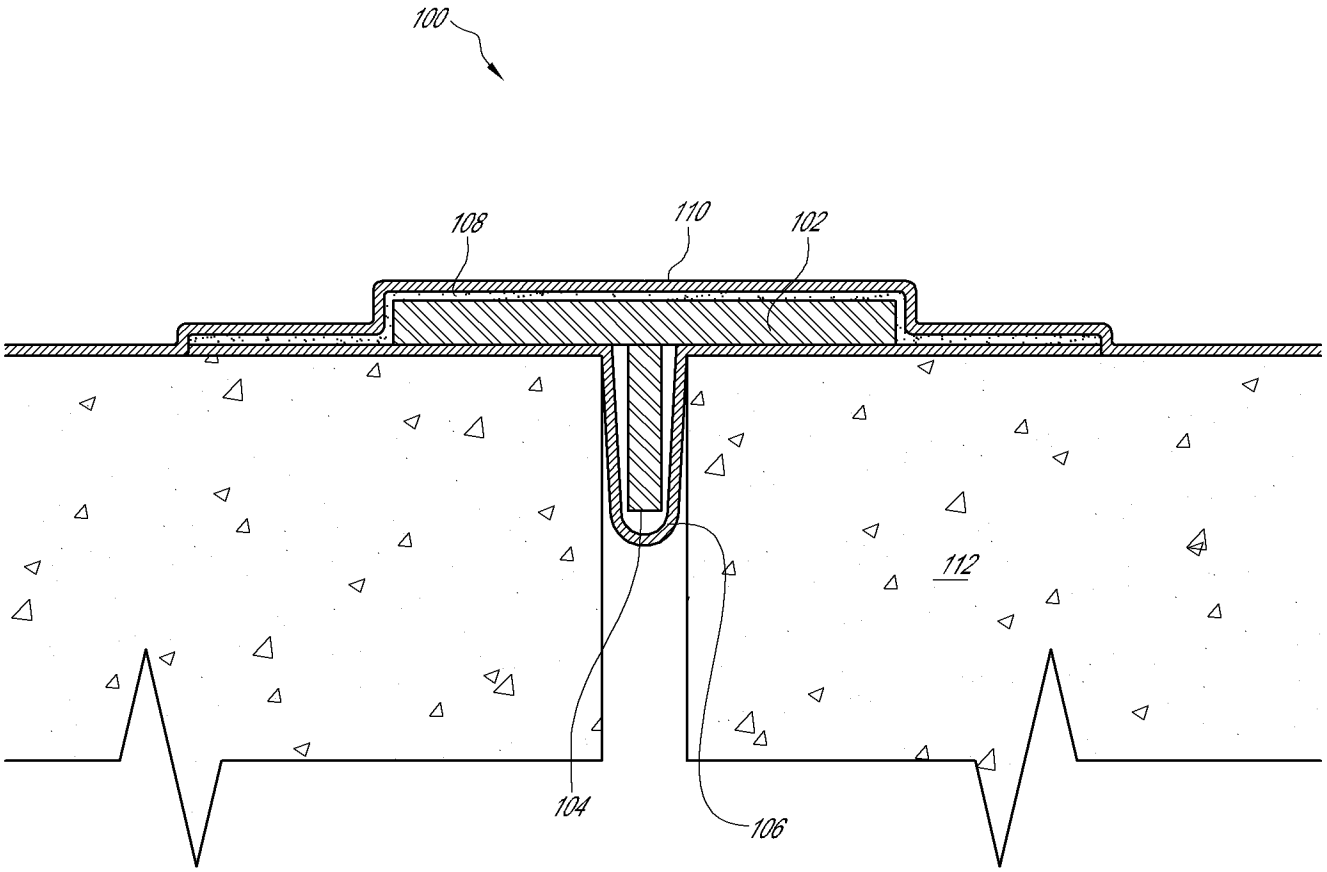
FIG. 1 is a cross-sectional view of one embodiment of a waterproof expansion joint for railway bridges.

FIG. 1 illustrates a cross sectional view of one embodiment of a waterproof expansion joint 100. The deck of a railway bridge can be composed of a plurality of box beam girders 112, which are then covered with ballast, for example crushed rock or gravel. Railroad tracks are installed on the ballast. The box beam girders 112 can be hollow girders formed from concrete or reinforced concrete, but may also be made of any other material of sufficient strength and durability to withstand the stress placed on a railway bridge. The girders 112 are placed side-by-side and/or end-to-end, depending on the specific requirements of the span. Adjacent box beam girders 112 can define deck joints 114. Deck joints 114 are spaces which allow expansion and contraction of girders 112 without causing damage to adjacent girders 112 or other components of the bridge. Generally, the deck joints 114 are covered by ballast protection plates 102 to inhibit the ballast from falling through the deck joints 114 and potentially creating a hazardous situation below the bridge. However, neither the ballast nor the ballast protection plates 102 are adequate to inhibit water from leaking through the deck joints 114. The waterproof expansion joint 100 of FIG. 1 adds several components to the traditional box girder bridge to inhibit water leakage through the deck joints 114.

The waterproof expansion joint 100 comprises a ballast protection plate 102 that is positioned over the deck joint 114. The ballast protection plate 102 can be configured to move laterally with respect to the deck joint 114 during the expansion and contraction of the girders 112 and the bridge as a whole. The ballast protection plate 102 has one or more centering tabs 104 to limit the amount of lateral movement of the ballast protection plate 102 with respect to the deck joint 114. Also, a waterproof receptacle, such as a T-cup 106, may be provided to facilitate the installation of a waterproof layer between the ballast protection plate 102 and the girders 112. The waterproof expansion joint 100 additionally includes a bond breaker 108 and one or more waterproof membranes 110. The T-cups 106 fit into the deck joint 114 between the girders 112, and are positioned to accept the centering tabs 104 of the ballast protection plate 102 when it is placed on the deck joint 114. The T-cups 106 can be covered with a layer of waterproof membrane 110 prior to installation of the ballast protection plate 102. The ballast protection plate 102 can be placed over the deck joint 114, with its centering tabs 104 inserted into the T-cups 106. A bond breaker 108 can be applied to the ballast protection plate 102, and a second layer of waterproof membrane 110 can be applied over the entire waterproof expansion joint 100.

The number of ballast protection plates 102 can depend on the specific features of the bridge. For example, a bridge comprising a large number of girders 112 can have a proportionately large number of deck joints 114, with each deck joint 114 requiring a ballast protection plate 102. The ballast protection plate 102 is generally elongate. In some embodiments, a ballast protection plate 102 can be created with alternative designs, such as L- and Z-shaped ballast protection plates 102, to cover a plurality of deck joints 114. The length of some deck joints 114 may require more than one ballast protection plate 102. In some embodiments, the ballast protection plate 102 is rectangular in shape. In some embodiments, the ballast protection plate 102 may have rounded edges and be generally oval in shape. The ballast protection plate 102 can be made of material sufficiently rigid to support the ballast under which will be placed, for example galvanized steel. The material of the ballast protection plate 102 can also be selected to resist any corrosive effects caused by the liquid leaking through the ballast that it is exposed to.

One or more centering tabs 104 can be rigidly attached to the underside of the ballast protection plate 102, for example by welding. Alternatively, the centering tabs 104 can riveted, bolted, or otherwise semi-permanently or permanently coupled to the ballast protection plate 102. The centering tabs 104 can be made of the same material as the ballast protection plate 102, and can be generally rectangular. In some embodiments, the centering tabs 104 can take an alternative shape that retains the ballast protection plate 102 in alignment with the joint, such as circular, triangular, etc. The centering tabs 104 can extend two (2) inches below the ballast protection plate 102. In some embodiments, the centering tabs 104 can extend more than two (2) inches below the ballast protection plate 102, depending on the width of the deck joint 114 and the range of expected change in elevation that the girders 114 will experience. For example, if the girders 114 of the bridge are expected to experience elevation changes in the range of 1.5 inches, a centering tab 104 extending more than 2 inches into the deck joint 114 may be desirable.

The centering tabs 104 inhibit the ballast protection plate 102 from shifting laterally, with respect to the deck joint 114, a distance great enough that the ballast protection plate 102 no longer covers the deck joint 114. In the absence of centering tabs 104, repetitive expansion and contraction of the girders 112 could potentially shift the position of the ballast protection plate 102 laterally and uncover the deck joint 114, allowing ballast to fall through the deck joint 114 and defeating the purpose of having a ballast protection plate 102. In such cases the ballast protection plate 102 itself could also fall through the deck joint 114, adding to the danger. To inhibit such excessive shifting of the ballast protection plate 102, one or more centering tabs 104 can be attached to the bottom face of the ballast protection plate 102, centered laterally between the edges of the ballast protection plate 102, with the longitudinal axis of the centering tabs 104 aligned parallel to the longitudinal axis of the ballast protection plate 102 and deck joint 114. The width of the ballast protection plate 102 is generally more than twice as wide as the widest anticipated width of the deck joint 114 between the girders 112. In this configuration, the position of the ballast protection plate 102 can shift only as far as the centering tab 104 will allow before the centering tab 104 contacts one of the girders 112. Because the centering tabs 104 are aligned with the longitudinal axis of the ballast protection plate 102, the ballast protection plate 102 will still completely cover the deck joint 114 and overlap onto both girders 112 even when the centering tab 104 is in contact with either of the girders 112.

In some embodiments, the width of a deck joint 114 may be exceptionally wide, and a ballast protection plate 102 with a single centering tab 104, centered laterally between the edges of the ballast protection plate 102, may allow an unacceptably large shift in the position of the ballast protection plate 102 with respect to the deck joint 114. In such cases, two or more centering tabs 104 may be mounted to the same segment of the ballast protection plate 102, positioned with their longitudinal axes parallel to each other and parallel to the longitudinal axis of the ballast protect plate 102. The dual centering tabs 104 provide the benefits described above, namely contacting the girders 114 and inhibiting excessive shift of the ballast protection plate 102. In the dual centering tab 104 configuration, each centering tab 104 is responsible for contacting only one of the girders 112 that define the deck joint 114.

One problem, among others, that is presented by centering tabs 104 mounted to the bottom face of the ballast protection plate 102 is that the protruding centering tabs 104 can prevent a waterproof sealant from being used below the ballast protection plate 102. Waterproof cup members, such as T-cups 106, can facilitate placement of a waterproof layer under the ballast protection plate 102. T-cups 106 can be placed in the deck joint 114 at the locations where the centering tabs 104 will enter the deck joints 114 when the ballast protection plate 102 is installed.

Figure 2:
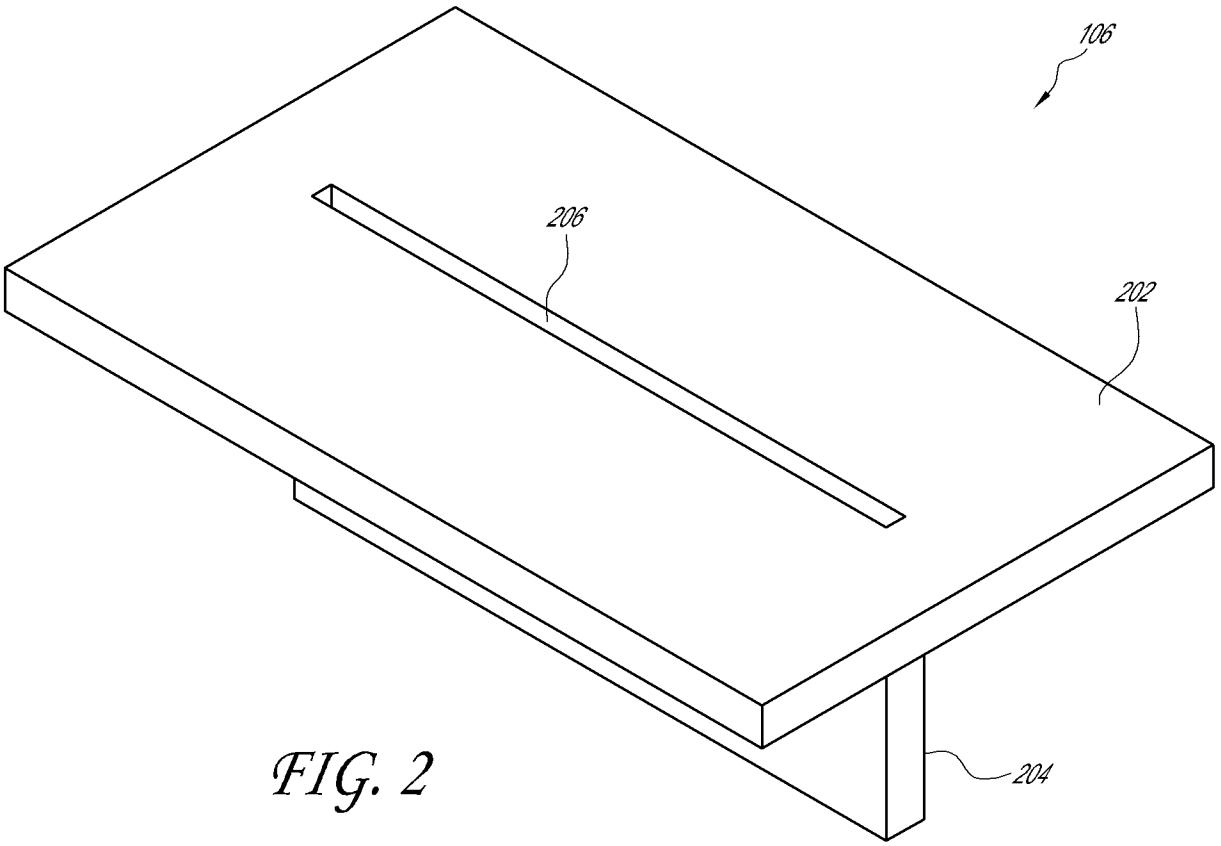
FIG. 2 is a perspective view of one embodiment of a T-cup waterproofing member.

FIG. 2 illustrates a perspective view of one embodiment of a T-cup 106 waterproof member. The T-cup 106 comprises a flange 202 and a cup 204. The flange 202 forms the upper end of the T-cup 106, and the cup 204 extends downward from the bottom face of the flange 202. The flange 202 defines the opening 206 of the cup 204, and extends completely around the opening 206 and the top edge of the cup 204. The flange 202 can be sized so that the entire top face of the T-cup 106 is substantially the same width as the ballast protection plate 102. The flange 106 can be configured so that the top face of the T-cup 106 is substantially rectangular or square. In some embodiments, the flange 106 can be configured to provide a round shape to the top face of the T-cup 106, which may reduce the material required to manufacture the T-cups 106 and thereby reduce manufacturing costs. The opening 206 can be substantially the same size as the interior of the cup 204. The cup 204 can be sized to fit the centering tabs 104 that will be inserted. Typically, the interior dimensions of the cup 204 will be slightly larger than the dimensions of the centering tabs 104, to facilitate installation while maintaining a snug fit. In some embodiments, the T-cup can have two or more openings 206 and cups 204, for example in applications requiring ballast protection plates 102 with dual centering tabs 104, as described above. In such applications, the T-cup can have two cups 204 aligned parallel to each other, with two openings 206 in the flange 202.

Prior to installation of the waterproof expansion joint 100, the surface of the bridge deck is preferably level. Due to the ballast that is placed on the girders 112 prior to installation of railroad tracks, the manufacturing and/or installation tolerance may not be precise because railroad tracks are not mounted directly to girders 112, but rather they are installed onto the ballast. Therefore, one or more girders 112 may not be level with the others. For example, the top surface of one girder 112 may be at a different elevation than a girder 112 on the other side of a deck joint 114. One problem that this presents, among others, is that the ballast protection plates 102 may not sit flat against the girders 112 on both sides of the deck joint 114. In such cases, grout, cement, or another type of patch can be applied to the girder 112 at the lower elevation to bring the surfaces of the two girders 112 level.

Assembly of the waterproof expansion joint 100 begins with placement of the T-cups 106. The T-cups 106 are preferably positioned where the tabs 104 of the ballast protection plate 102 will enter the deck joint 114 between the girders 112. This pre-placement allows a waterproof layer, such as waterproof membrane 110, to be applied prior to final placement of the ballast protection plates 102, as described in detail below. Pre-placement can involve temporarily installing the T-cups 106 on the ballast protection plate 102. The T-cups 106 are placed on the centering tabs 104, and then the ballast protection plate 102 is then placed over the deck joint 114 between the girders 112, with the centering tabs 104 and T-cups 106 extending downward into the deck joint 114. The position of the T-cups 106 can be marked on the girders 112 for future reference. The ballast protection plate 102 is then removed, and the T-cups 106 can either remain in place or be removed with the ballast protection plate 102 and replaced in the deck joint 114 between the girders 112 at the marked positions. In some embodiments, the ballast protection plate 102 is not temporarily installed. Instead, the space between each centering tab 104 is measured, and markings are made on the girders 112 based upon these measurements to indicate where the T-cups 106 are to be installed.

Figure 3:
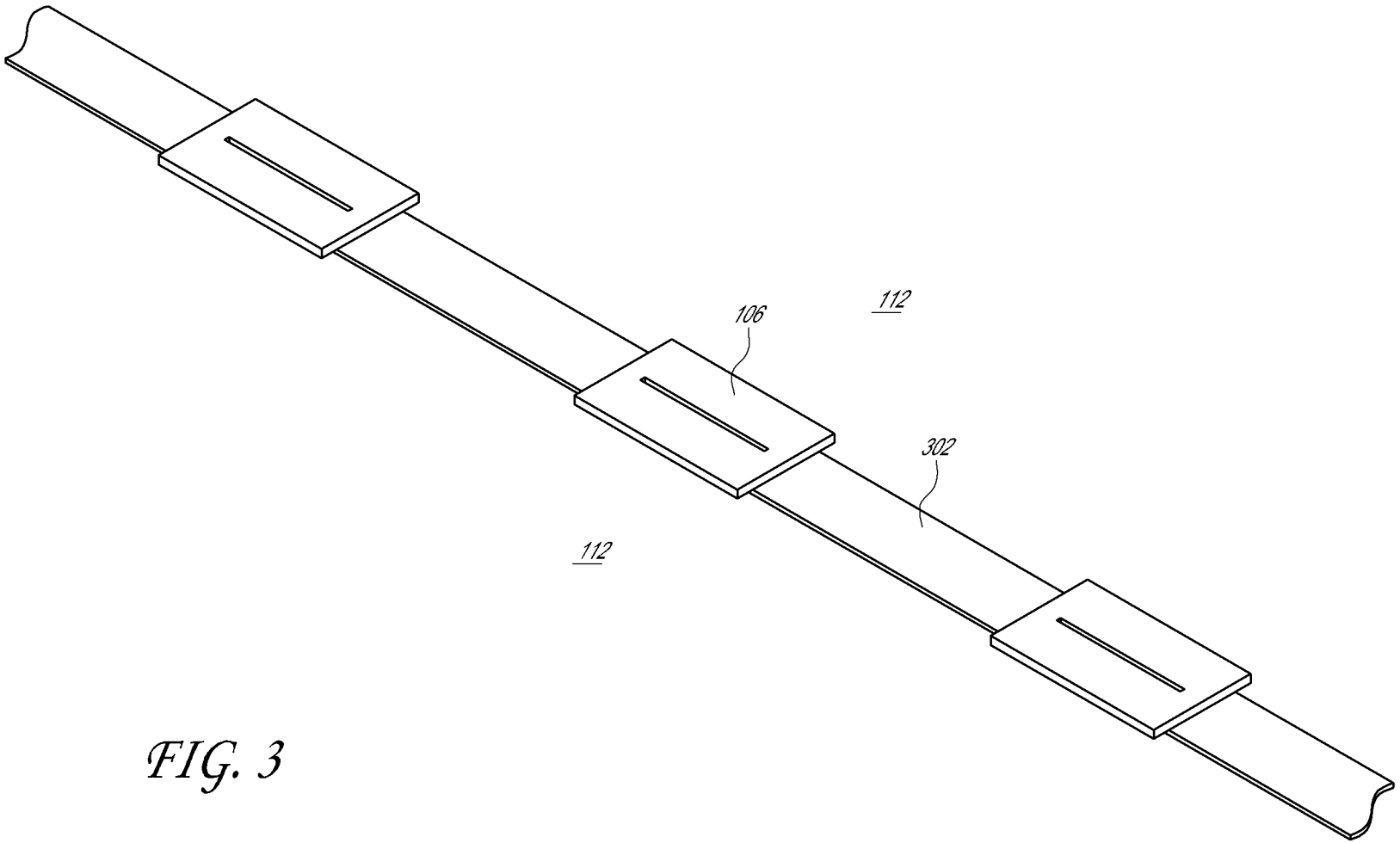
FIG. 3 is a perspective view of one embodiment of a waterproof expansion joint in the process of being installed, illustrating T-cup waterproofing members and sealing tape.

FIG. 3 illustrates a perspective view of one embodiment of a deck joint 114 with T-cups 106 positioned to accept the centering tabs 104 of a ballast protection plate 102. After the proper position of the T-cups 106 is marked, as described above, the T-cups 106 are placed into the deck joint 114, with the flange 202 of each T-cup 106 contacting the upper surface of the girders 112 on each side of the deck joint 114. The flange 202 prevents the T-cup 106 from falling through the deck joint 114.

The portions of the deck joints 114 that are not covered by the T-cups 106 are sealed with sealing tape 302. Sealing tape 302 is installed between the T-cups 106, and covers the deck joint 114 while overlapping onto the edge of each of the girders 112. The sealing tape 302 can be fiber-reinforced butyl tape. The sealing tape 302 can be installed while the T-cups 106 are in position, by partially lifting the flange 202 of each T-cup 106 to place the sealing tape 302 underneath. Alternatively, the T-cups 106 can be removed after marking their proper position, as described above with respect to FIG. 3, and the sealing tape 302 can be installed prior to replacing the T-cups 106 at the positions marked. The sealing tape 302, when coupled with the T-cups 106, provides a waterproof layer covering the entire deck joint 114.

Figure 4:
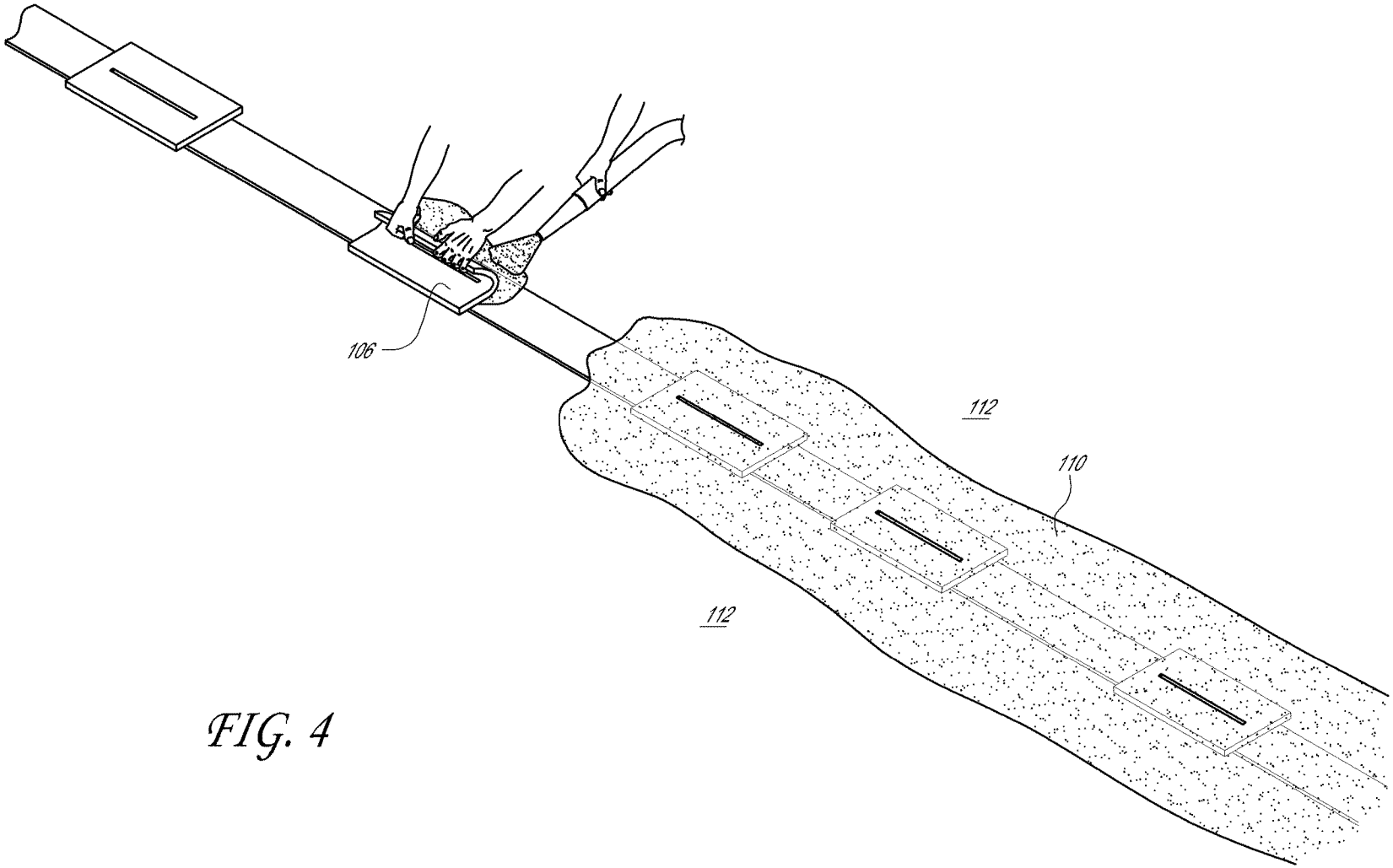
FIG. 4 is a perspective view of one embodiment of a waterproof expansion joint in the process of being installed, illustrating waterproof membrane being applied.

FIG. 4 illustrates one embodiment of the waterproof expansion joint 100 of FIG. 3 at a later stage of installation. After the sealing tape 302 has been installed and the T-cups 106 are in position, a waterproof membrane 110 is installed. The waterproof membrane 110 can be a polyurea, such as AquaVers 405™. As described in more detail below, each layer of the waterproof membrane can be 100 mils.

An adhesive layer is installed between the flange 202 of each T-cup 106 and a girder 112. The adhesive layer can be a primer application and can be applied prior to the placement of the waterproof membrane 110. The adhesive layer can be the same material as all or part of the waterproof membrane 110, such as a polyurea. The adhesive layer can be applied by spraying the material while it is in a substantially fluid state. The flange 202 can then be lowered back into place, with the adhesive layer acting to hold the T-cup 106 in its proper position and effectively sealing the area where the flange 202 of each T-cup 102 meets the surface of each girder 112. In some embodiments, there is no adhesive layer applied between the flange 202 of the T-cups 106 and the girder 112.

As illustrated in FIG. 4, the waterproof membrane 110 can be applied by spraying the material while it is in a substantially fluid state. After each T-cup 106 has been sealed to the girders 114 with an adhesive layer, waterproof membrane 110 can be applied to the top of each T-cup 106 and each section of sealing tape 302. The end result of this application of the waterproof membrane 110 can be one layer of waterproof membrane 110 along the entire length of the deck joint 114. The width of the layer of waterproof membrane 110 is typically greater than the width of the ballast protection plates 102 that will be installed onto the deck joint 114. In this configuration, the waterproof membrane 110, the T-cups 106, and sealing tape 302 form a waterproof base layer upon which to install the ballast protection plate 102.

Figure 5:
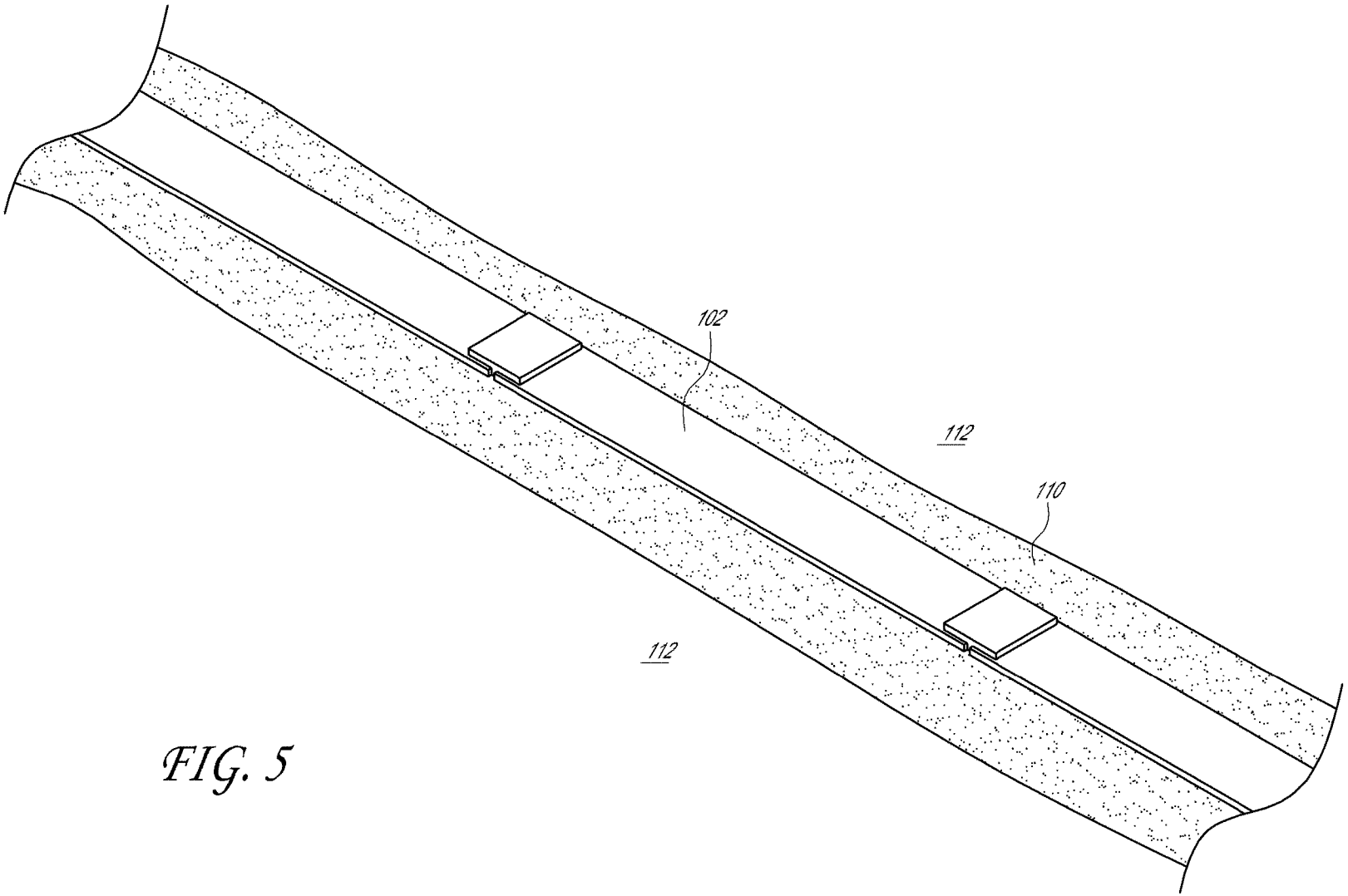
FIG. 5 is a perspective view of one embodiment of a waterproof expansion joint in the process of being installed, illustrating ballast protection plates.

The assembly process illustrated in FIG. 5 is a continuation of the process illustrated in FIG. 4. After the base layer of waterproof membrane 110 has been applied over the sealing tape 302 and T-cups 106, the ballast protection plate 102 can be installed. Generally, the ballast protection plate 102 is placed over the deck joint 114, with the centering tabs 104 extending through the opening 204 and into the cup 206 of each T-cup 106. The waterproof membrane 110 can be seen in FIG. 5 under and adjacent the ballast protection plate 102 on the box beam girders 112. In some embodiments, more than one ballast protection plate 102 can be installed, for example when the deck joint 114 is longer than a single ballast protection plate 102.

Figure 6:
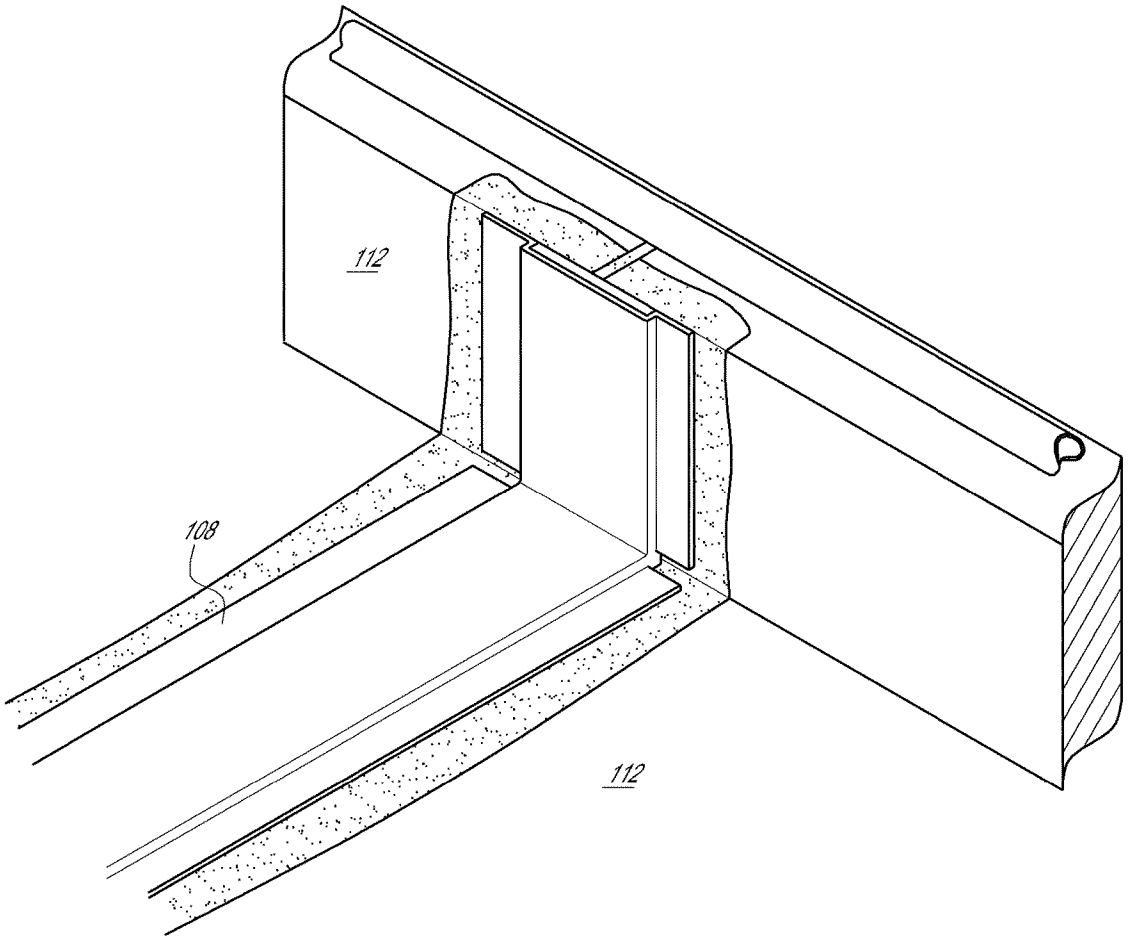
FIG. 6 is a perspective view of one embodiment of a waterproof expansion joint in the process of being installed, illustrating bond breaker.

FIG. 6 illustrates a perspective view of one embodiment of the waterproof expansion joint 100 of FIG. 5 at a later stage of installation. The edge of the expansion joint 100 illustrated in FIG. 5 is at the side of the bridge, a location where the bridge can have raised edges. Like the flat deck of the bridge, the raised edges can also have deck joints to allow for expansion and contraction. Therefore, the various components of the waterproof expansion joint 100 can also be used to waterproof the deck joint in the bridge's raised edge, including a ballast protection plate 102, bond breaker 108, waterproof membrane 110, etc.

When the ballast protection plates 102 have been installed, a bond breaker 108 can be applied. The bond breaker 108 covers the ballast protection plate 102 and overlaps the waterproof membrane 110 that has been sprayed onto the girders 112. The bond breaker 108 can be roofing tape, melroe tape, etc. The bond breaker 108 provides a unified surface upon which to apply a second layer of waterproof membrane 110, as described below, and also facilitates the movement of the ballast protection plate 102. When the girders 112 expand and contract the deck joint 114 in which the components of the waterproof expansion joint 100 are installed, the ballast protection plate 102 can shift position laterally, perpendicular to the deck joint 114 and to the longitudinal axis of the ballast protection plate 102. The bond breaker 108 allows such movement by the ballast protection plate 102 without compromising the seal of the waterproof membrane 110 installed on top of the bond breaker 108, as described in detail below, by inhibiting formation of a permanent bond between the ballast protection plate 102, and the second layer of waterproof membrane 110 installed on top of the bond breaker 108.

Figure 7:
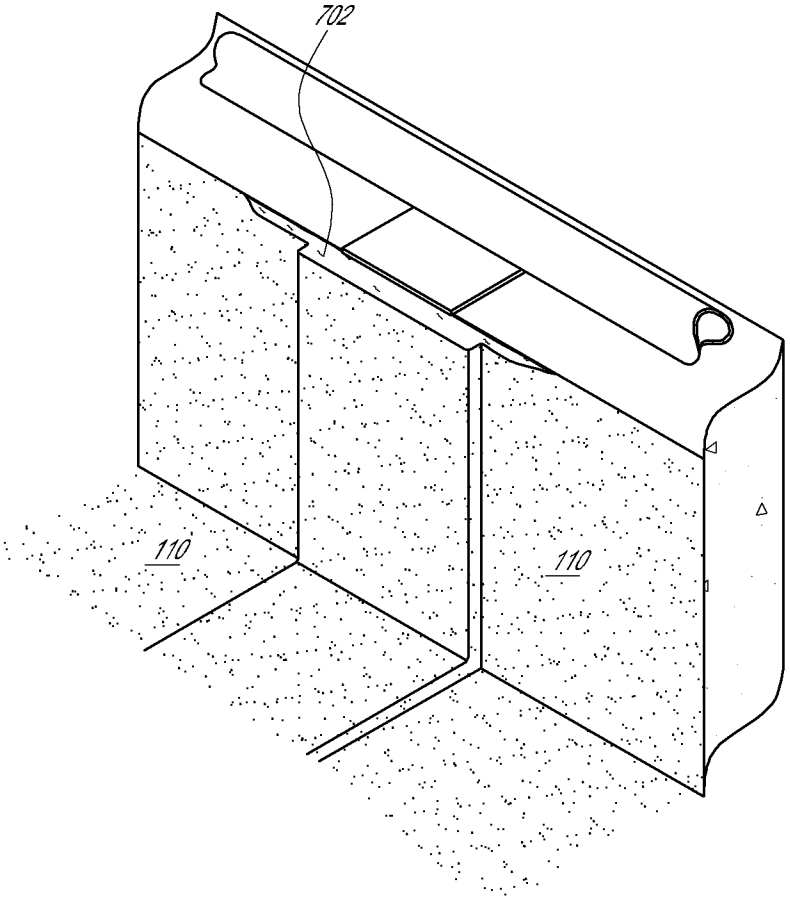
FIG. 7 is a perspective view of one embodiment of a waterproof expansion joint fully installed.

FIG. 7 illustrates a perspective view of one embodiment of a waterproof expansion joint 100 fully assembled and installed. The view illustrated in FIG. 7 includes a raised edge of the bridge, described above with respect to FIG. 6. The components installed as described in detail above are shown in FIG. 7 completely covered with a second layer of waterproof membrane 110. As in FIG. 4, described above, the second layer waterproof membrane 110 can be applied by spraying the material while it is in a substantially fluid state. The second layer of waterproof membrane 110 is between 10 and 150 millimeters thick, and may be 80 to 120 millimeters thick. In some embodiments, the second layer of waterproof membrane 110 can be 100 mils thick.

The second layer of waterproof membrane 110 can cover all or part of the bond breaker-covered ballast protection plates 102 and/or may also cover all or part of one or more surfaces of the girders 112. In some embodiments, the second layer of waterproof membrane 110 can cover substantially the entire dorsal surface of the bridge deck. The second layer of waterproof membrane 110 defines a substantially horizontal fluid tight seal on the surface of the bridge deck. In embodiments in which the second layer of waterproof membrane 110 covers the entire dorsal surface of the bridge deck, there will be no seams in the second layer of waterproof membrane 110, which may reduce weak points in the fluid tight seal.

The location where deck joint 114 reaches the end of a pair of girders 112 can present an area of weakness in the overall waterproof expansion joint 100. As shown in FIG. 7, where the edges of the deck joint 114, girders 112, ballast protection plate 102, and other components of the waterproof expansion joint 100 align, caulking 702 may be applied to provide a fluid tight seal. The fluid tight seal formed by the second layer of waterproof membrane, coupled with the caulking 702, T-cups 106, sealing tape 302, and first layer of waterproof membrane 110, advantageously increases the distance a fluid must penetrate before breaching the seal, and prevents a failure in the seal at one isolated position from allowing fluids to penetrate the seal.

Figure 8A:
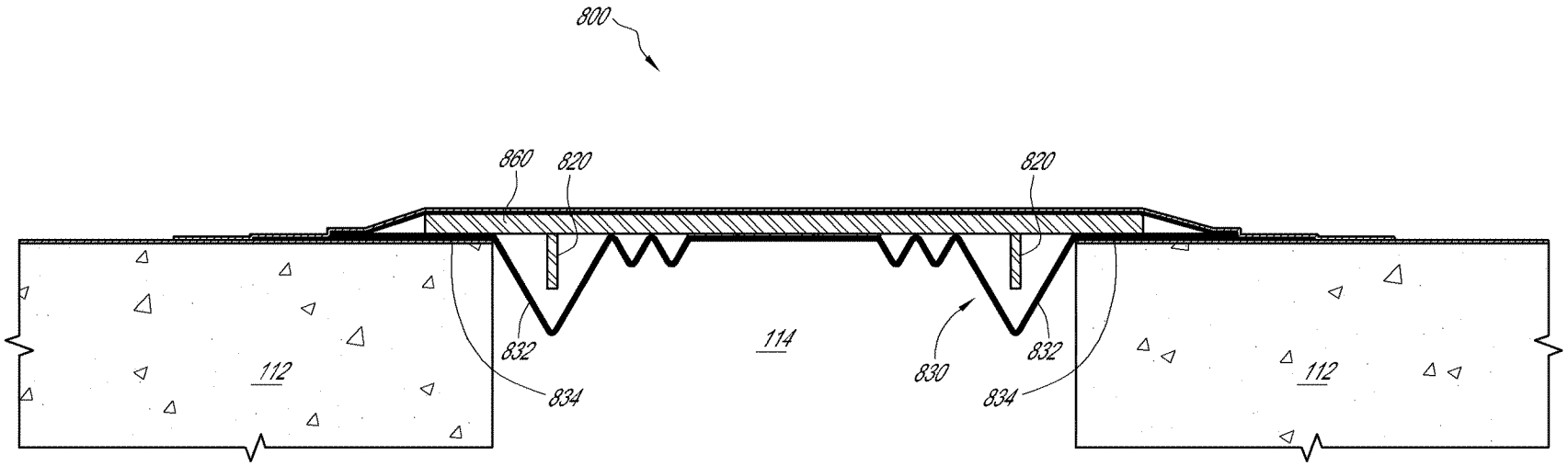
FIG. 8A is a cross-sectional view of one embodiment of a waterproof expansion joint installed on a larger deck joint including one embodiment of a locating device.

FIG. 8A is a cross-sectional view of one embodiment of a waterproof expansion joint 800 installed on a larger deck joint 114 including one embodiment of a locating device 820. The waterproof expansion joint 800 of FIG. 8A adds several components to the traditional box girder bridge to inhibit water leakage through the deck joint 114. In one embodiment, the waterproof expansion joint 800 comprises a ballast protection plate 860 that is positioned over the deck joint 114. The ballast protection plate 860 can be configured to move laterally with respect to the deck joint 114 during expansion and contraction of the girders 112 and the bridge as a whole. In some embodiments, the waterproof expansion joint 800 can include at least one locating device 820 configured to limit the lateral movement of the ballast protection plate 860 with respect to the deck joint 114. In some embodiments, the locating device 820 can be affixed to the ballast protection plate 860. One example of a locating device 820 is a centering tab as discussed above. In some embodiments, the waterproof expansion joint 800 can incorporate more than one locating device 820. Multiple locating devices 820 can be especially important when the width of the deck joint 114 is large and the movement of the ballast protection plate 860 must be limited so that it does not fall through the deck joint 114. Multiple locating devices 820 can also minimize the necessary width of the ballast protection plate 820 to prevent the ballast protection plate 820 from falling through the deck joint 114. In some embodiments, the locating devices 820 can comprise multiple centering tabs as illustrated in FIG. 8A.

In some embodiments, in order to inhibit water leakage through the deck joint 114, the waterproof expansion joint 800 can include a flexible sealing member 830. The flexible sealing member 830 can be configured to provide a waterproof layer between the ballast protection plate 860 and the deck joint 114 and girders 112. In some embodiments, the flexible sealing member 830 includes a flange portion 834 on each side configured to rest on top of a portion of the top surface of the girder 112. The flexible sealing member 834 can also include a deck joint portion which spans the gap between each girder 112. In some embodiments, the flexible sealing member 830 is installed below the ballast protection plate 860. In some embodiments, the flexible sealing member 830 is configured to extend vertically down into the deck joint 114. In some embodiments, the flexible sealing member 830 comprises a stretchable material, allowing the flexible sealing 830 member to flex and stretch in response to changes in width of the deck joint 114 and movement of the girders 112 relative to one another, in a variety of directions.

Figure 8B:
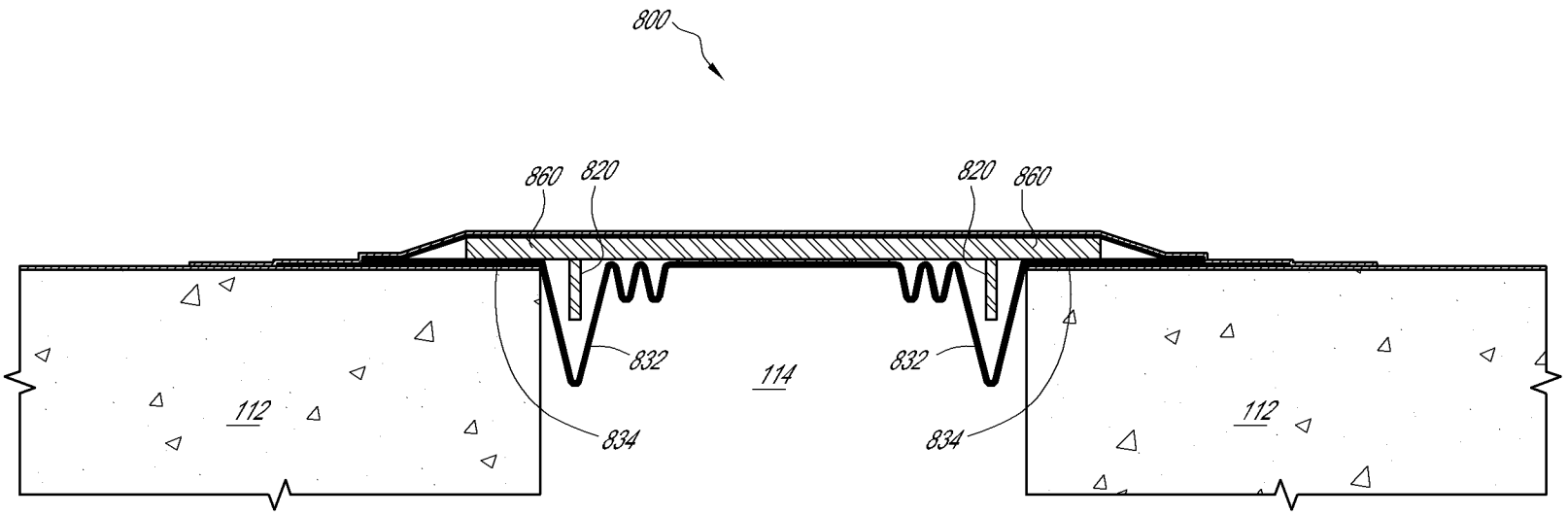
FIG. 8B is a cross-sectional view of one embodiment of a waterproof expansion joint installed on a smaller deck joint including one embodiment of a locating device.

In some embodiments, the flexible sealing member 830 can include at least one expansion feature 832. In some embodiments, the expansion features 832 allow the flexible sealing member 830 to flex and stretch further than if the flexible sealing member 830 did not include expansion features 832. In some embodiments, the expansion features 832 allow a particular size and configuration flexible sealing member 830 to be used in a variety of applications which may include, for example, different width deck joints 114. In some embodiments, the expansion feature 832 can include a protrusion extending downward into the deck joint 114. In some embodiments, the expansion feature 832 can include a shape preformed into the flexible sealing member 830. In some embodiments the expansion feature 832 is configured to deflect, such that the width of the flexible sealing member 830 can vary depending on the width of the deck joint 114 without compromising the structural integrity or waterproof nature of the flexible sealing member 830. In some embodiments, the shape of the expansion feature 832 may change during changes in the width of the flexible sealing member 830. In some embodiments, the expansion feature 832 can include a "V" shaped configuration in the flexible sealing member 830 as illustrated in FIG. 8A. In some embodiments, the expansion feature 832 can act like an accordion, collapsing into a tighter "V" when installed into a smaller deck joint 114 as illustrated in FIG. 8B or expanding into a wider "V" when installed in a larger deck joint 114 as illustrated in FIG. 8A. In some embodiments, the angle formed by the "V" shape can change depending on the width of the deck joint 114. The expansion features 832 can also be useful in maintaining a waterproof seal when the width of the deck joint 114 fluctuates during use. In some embodiments, the flexible sealing member 830 can include a plurality of expansion features 832. In some embodiments, the plurality of expansion features 832 may include the same geometry or size. In some embodiments, the plurality of expansion features 832 may include different geometries or different sizes as illustrated in FIG. 8A. In some embodiments, as illustrated in FIG. 8A, at least one of the expansion features 832 can be configured to receive, or allow for, a locating device 820 located on the underside of the ballast protection plate 860. In some embodiments, the expansion feature 832 can be configured so that a recess is located where the locating device 820 is located so that the flexible sealing member 830 is compatible with ballast protection plates 860 incorporating centering tabs. In some embodiments, at least one locating device 820 comprises a centering tab and each centering tab protrudes into a recess in the flexible sealing member 830 formed by an expansion feature 832. In other embodiments, different configurations of expansion features 832 are possible.

In some embodiments, in order to prevent the flexible sealing member 830 from sagging into the deck joint 114, portions of the flexible sealing member 830 may be adhered to the ballast protection plate 860 as illustrated in FIG. 8A. In some embodiments, an adhesive layer may be used to attach the flexible sealing member 830 to the ballast protection plate 860. In some embodiments, the flexible sealing member 830 can be adhered to the ballast protection plate 860 in a central location, allowing the expansion features 832 located on either side of the central location to expand and contract during movement of the girders 112 relative to one another. In some embodiments, portions of the flexible sealing member 830 may not be adhered directly to the ballast protection plate 860 as described below.

FIG. 8B is a cross-sectional view of one embodiment of a waterproof expansion joint 800 installed on a smaller deck joint 114 including one embodiment of a locating device 820. In some embodiments, as discussed above, the flexible sealing member 830 is adapted fit a variety of applications, including small and large width deck joints 114. In some embodiments, a particular size and configuration flexible sealing member 830 can be capable of sealing deck joints 114 between approximately 4" and 10" wide. In other embodiments, a particular size and configuration flexible sealing member 830 can be capable of sealing a variety of approximate deck joint 114 width ranges depending on its construction which may include, for example, 2" to 8", 2" to 10", 2" to 12", 2" to 14", 2" to 16", 2" to 18", 4" to 8", 4" to 10", 4" to 12", 4" to 14", 4" to 16", 4" to 18", 6" to 8", 6" to 10", 6" to 12", 6" to 14", 6" to 16", 6" to 18", etc. In some embodiments, a flexible sealing member 830 can be capable of sealing a range of deck joint 114 widths which lies within the range of 2" to 40". When installed in a smaller deck joint, as illustrated in FIG. 8B, the expansion features 832 can be configured to adapt to the reduction in width of the deck joint 114 and maintain their structural integrity and waterproofing qualities. In some embodiments, the flexible sealing member 830 can be manufactured in sections. In some embodiments, the flexible sealing member 830 can be configured to overlap with other portions of the flexible sealing member 830. In some embodiments, the overlapping sections of the flexible sealing members 830 can be attached to one another using an adhesive layer.

Figure 9:
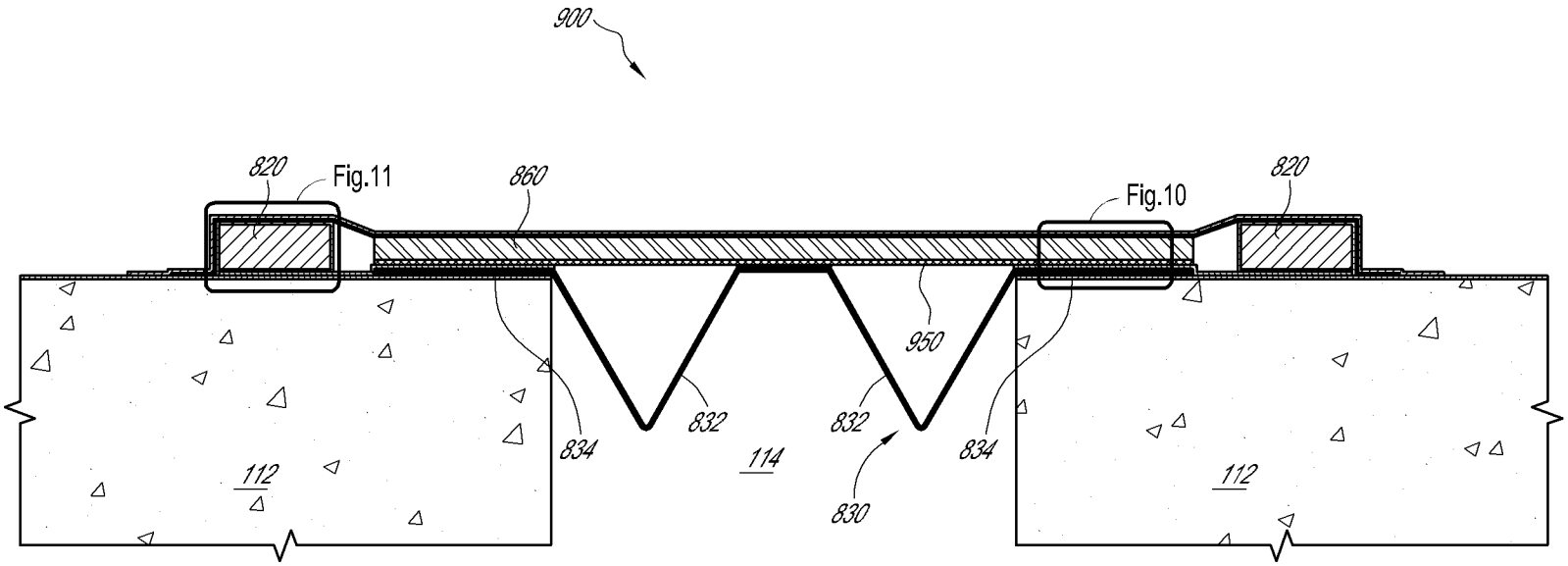
FIG. 9 is a cross-sectional view of one embodiment of a waterproof expansion joint including one embodiment of a locating device.

FIG. 9 is a cross-sectional view of one embodiment of a waterproof expansion joint 900 including one embodiment of a locating device 820. In some embodiments, the waterproof expansion joint 900 can include an alternative embodiment of locating device 820. In some embodiments, the locating devices 820, which may include for example plate end guides as illustrated in FIG. 9, can be adhered to the girders 112 rather than the ballast protection plate 860 like the centering tabs discussed above. In some embodiments, the locating devices 820 can be positioned on the top surface of the girders 112 on either side of the ballast protection plate 860. In some embodiments, the location of the locating devices 820 is determined by the expected amount of fluctuation in the width of the deck joint 114. The locating devices 820 can be adhered to the girders 112 with an adhesive layer, which prevents the locating devices 820 from moving relative to the edge of each girder 112 adjacent the deck joint 114. By surrounding the ballast protection plate 860 on either side by a locating device 820, the lateral movement of the ballast protection plate 860 can be limited, preventing the ballast protection plate 860 from shifting too far laterally in either direction and falling through the deck joint 114. In some embodiments, the locating device 820 can include an elongate member which runs alongside the ballast protection plate 860. In some embodiments, the locating device 820 is located on top of a girder 112.

In some embodiments, the locating device 820 is spaced a distance from the edge of the ballast protection plate 860 large enough to allow for variation in the width of the deck joint 114 but not large enough to allow the ballast protection plate 860 to fall through the deck joint 114. In some embodiments, the locating device 820 can be as long or longer than each section of ballast protection plate 860. In some embodiments, the locating device 820 can be shorter than each section of ballast protection plate 860. In some embodiments, multiple locating devices 820 can be included along each section of ballast protection plate 860. In some embodiments, the cross section of the locating device 820 can be rectangular as illustrated in FIG. 9. In other embodiments, other configurations are possible.

In some embodiments, using plate end guides as locating devices 820 can be advantageous to using centering tabs as locating devices 820. In some situations, the configuration of the waterproof expansion joint 900 may have to be adjusted in the field during installation. This can include for example, modifying the location of the locating devices 820 to allow for different width deck joints 114 or other circumstances. The modification of some locating devices 820, which may include for example centering tabs, may require cutting and welding. Such procedures are time consuming, require expensive and difficult to transport equipment, and can also damage coatings applied to the ballast protection plate 860 intended to prevent corrosion. In addition, the manufacture of a ballast protection plate 860 incorporating locating devices 820 can be expensive. The use of a locating device 820, which may include for example a plate end guide, which is not incorporated into the ballast protection plate 860, includes several advantages. If an installation crew needs to adjust for a different width deck joint 114 in the field, rather than going through the expensive and time consuming process of modifying a ballast protection plate 860 in the field and possibly damaging a coating on the ballast protection plate 860, they can simply account for the difference in the width of the deck joint 114 by installing the plate end guides in the appropriate location to allow for the proper amount of lateral movement of the ballast protection plate 860. In addition, the plate end guides allow for the use of a standard sheet of material for the ballast protection plate 860, versus a centering tab configuration which requires fabrication and welding procedures custom tailored to each particular project. This allows the installation crew to not only source less expensive ballast protection plates 860, but to receive them quicker without the delay of the additional manufacturing processes.

In some embodiments, the waterproof expansion joint 900 can include a joint support plate as illustrated in FIG. 9. Rather than attaching a portion of the flexible sealing member 830 directly to the ballast protection plate 860 as in FIG. 8A, the flexible sealing member 830 can be attached to a joint support plate 950. In some embodiments, the ballast protection plate 860 can be heavy and difficult to maneuver, making it difficult to flip the ballast protection plate 860 over in the field to attach a portion of the flexible sealing member 830 to its underside. In some embodiments, the ballast protection plate 860 may not be chemically compatible with certain adhesives which would inhibit the attachment of a portion of the flexible sealing member 860 to the ballast protection plate. When used herein, the term chemically compatible generally refers to a quality of a portion of the waterproof expansion joint which is capable of bonding and adhering to another portion of the waterproof expansion joint. In some embodiments, portions of the waterproof expansion joint may be chemically compatible because they comprise the same material, which can include for example, polyurea.

A joint support plate 950 can be a lightweight panel installed beneath the ballast protection plate 860 to which a portion of the flexible sealing member 830 can be attached. In some embodiments, the flexible sealing member 830 can be attached to the joint support plate 950 using an adhesive. In some embodiments, the adhesive can be the same adhesive used in other portions of the waterproof expansion joint. In some embodiments the joint support plate 950 can share substantially similar dimensions with the ballast protection plate 860. In some embodiments, the joint support plate 950 can be thinner in the height dimension than the ballast protection plate 860. In other embodiments, the joint support plate 950 can incorporate different dimensions than the ballast protection plate 860. In some embodiments, the primary purpose of the joint support plate 950 is to support the flexible sealing member 830 while the ballast protection plate 860 supports the heavy weight of the ballast. In some embodiments, the joint support plate 950 can comprise materials chemically compatible with adhesives used in the waterproof expansion joint. In some embodiments, the joint support plate 950 can comprise composite materials.

Figure 10:
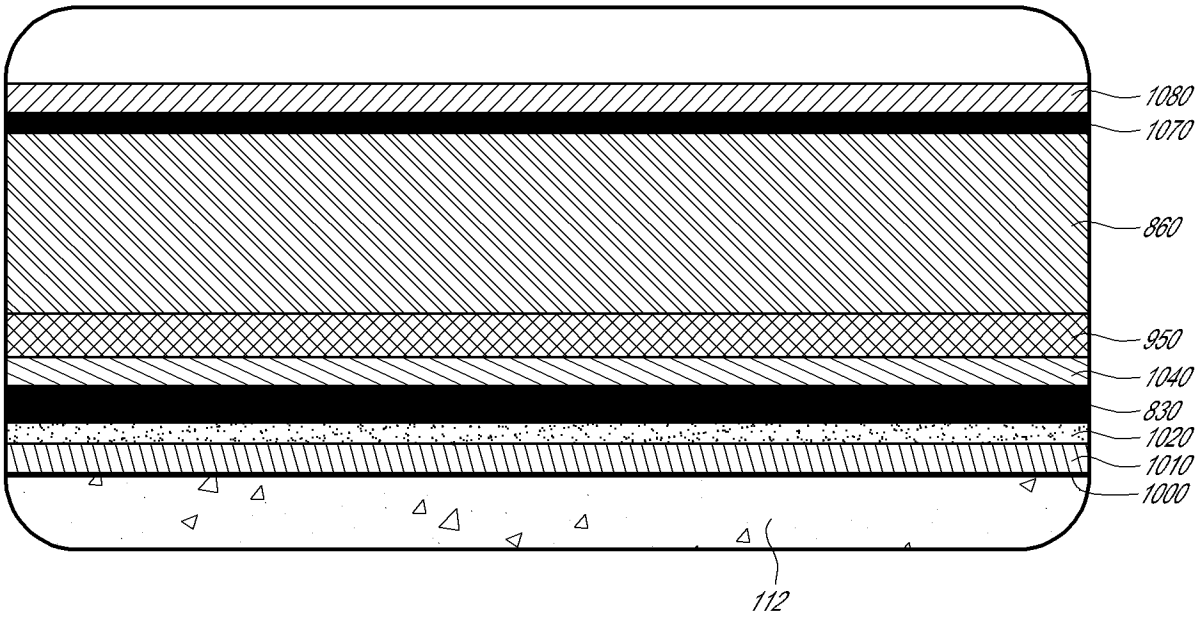
FIG. 10 is a cross-sectional detail view of one embodiment of a waterproof expansion joint.

FIG. 10 is a cross-sectional detail view of one embodiment of a waterproof expansion joint 900. In some embodiments, the waterproof expansion joint 900 incorporates several layers to ensure a waterproof seal and inhibit water from entering the waterproof expansion joint 900. In some embodiments, the waterproof expansion joint 900 also incorporates layers to inhibit water from reaching the ballast protection 860 plate to minimize corrosion.

In one embodiment, the waterproof expansion joint 900 can include a primer 1000. The primer 1000 can be applied to the girders 112 prior to the installation of the rest of the waterproof expansion joint 900. In some embodiments, the primer 1000 can be a concrete primer which can be configured to penetrate into the pores of concrete girders 112 and adhere to the concrete girders 112. In some embodiments, the primer 1000 is chemically compatible with other portions of the waterproof expansion joint 900. In some embodiments, the primer 1000 can provide a surface to which other portions of the waterproof expansion joint 900 can bond to. In some embodiments, the primer 1000 can promote adhesion of a portion of the waterproof expansion joint 900, which may include for example, the bridge deck waterproof membrane 1010 or the flexible sealing member 830, to the girders 112. In some embodiments, the primer 1000 can comprise a multi-part mix which is combined in the field and poured on the bridge deck. In some embodiments the mix can include urethane material. In some embodiments, the mix can include polyurea. In some embodiments the primer 1000 coat can be approximately 0.1 to 1 millimeters thick. In some embodiments, the primer 1000 coat can be thinner than 0.1 millimeters thick. In some embodiments, the primer 1000 coat can be greater than 1 millimeter thick. In some embodiments, the primer 1000 coat can be approximately 0.1 to 0.5 millimeters thick. In some embodiments, the primer 1000 coat can be approximately 0.25 to 0.5 millimeters thick. In some embodiments, the primer 1000 coat can be approximately 0.3 millimeters thick.

In some embodiments, the waterproof expansion joint 900 can include a bridge deck waterproof membrane 1010, which for example, can be similar to the other waterproof membranes discussed herein. In some embodiments, the bridge deck waterproof membrane 1010 can be approximately 1 to 5 millimeters thick. In other embodiments, the bridge deck waterproof membrane 1010 can be less than 1 millimeter thick. In other embodiments, the bridge deck waterproof membrane 1010 can be greater than 5 millimeters thick. In some embodiments, the bridge deck waterproof membrane 1010 can be installed directly on top of the girder 112. In some embodiments, the bridge deck waterproof membrane 1010 can be installed onto a primer 1000 which has been installed on top of the girder 112. In some embodiments, the bridge deck waterproof membrane 1010 can be installed by spraying the bridge deck waterproof membrane 1010 when it is in a substantially fluid state. In some embodiments, the bridge deck waterproof membrane 1010 can be installed with a roller. Other methods of installation of the bridge deck waterproof membrane 1010 are possible. In some embodiments, the bridge deck waterproof membrane 1010 is configured to set quickly so that the material can be installed quickly in the field without waiting a significant amount of time for any membrane already installed to set. In some embodiments the bridge deck waterproof membrane 1010 will gel in approximately 6 seconds and set up in approximately 15 seconds.

In some embodiments, the waterproof expansion joint 900 can include an adhesive layer 1020. In some embodiments, the adhesive layer 1020 can be approximately 1 to 5 millimeters thick. In other embodiments, the adhesive layer 1020 can be less than 1 millimeter thick. In other embodiments, the adhesive layer 1020 can be greater than 5 millimeters thick. In some embodiments, the adhesive layer 1020 is chemically compatible with other portions of the waterproof expansion joint 900 such that the adhesive layer 1020 can bond with other portions of the waterproof expansion joint 900 forming a waterproof seal. In some embodiments, the adhesive layer 1020 can comprise the same material as other portions of the waterproof expansion joint 900 so that when the portions are bonded together they form a waterproof monolithic structure. The adhesive layer 1020 can be installed in a variety of methods which may include, pouring, rolling, spraying, application of preformed strips, etc. In some embodiments, the adhesive layer 1020 may have a set time long enough to allow the application of subsequent portions of the waterproof expansion joint 900 before the adhesive layer 1020 sets, bonding the portions of the waterproof expansion joint together.

In some embodiments, a flexible sealing member 830 as discussed above can be installed as part of the waterproof expansion joint 900. In some embodiments, the flange portion 834 on each side of the flexible sealing member 830 can be installed onto the adhesive layer 1020, attaching either side of the flexible sealing member 830 to each girder 112, with the deck joint portion spanning the deck joint. In some embodiments, the flexible sealing member 830 can be prefabricated before being brought to the installation site. In some embodiments, the flexible sealing member 830 can be constructed in a mold. In some embodiments, the material forming the flexible sealing member 830 can be sprayed into a mold, and allowed to cure in the configuration of the mold.

In some embodiments, an additional layer of waterproof membrane 1040 is applied over the top of at least a portion of the flange portion 834 of the flexible sealing member 830 of the waterproof expansion joint 900. In some embodiments, the waterproof membrane 1040 will bond to the flexible sealing member 830 forming a waterproof seal. In some embodiments, the waterproof membrane 1040 comprises the same material as the flexible sealing member 830, such that when the portions are bonded together they form a waterproof monolithic structure. In some embodiments, the waterproof membrane 1040 extends past the end of the flexible sealing member 830 and over at least a portion of the girder 112. In some embodiments the waterproof membrane 1040 can bond to the girder 112. In some embodiments, the waterproof membrane 1040 can bond to a layer of bridge deck waterproof membrane 1010 on the girder 112 which was applied previously. In some embodiments, the waterproof membrane 1040 can bond to a primer 1000 which was applied previously. The additional layer of waterproof membrane 1040 can help to inhibit the entry of water through the deck joint 114.

In some embodiments, the waterproof expansion joint 900 can include a joint support plate 950 as discussed above. In some embodiments, the joint support plate 950 is free to slide in each direction on the layer below, which may include for example, a waterproof membrane 1040 as illustrated in FIG. 10, a flexible sealing member 830, etc.

In some embodiments, the waterproof expansion joint 900 can include a ballast protection plate 860 as discussed above. In some embodiments, the ballast protection plate 860 is free to slide in each direction on the layer below, which may include for example, a waterproof membrane 1040 as illustrated in FIG. 8A, a joint support plate 950 as illustrated in FIG. 10, a flexible sealing member 830, etc. In some embodiments the ballast protection plate 860 and joint support plate 950 may not be configured to slide relative to one another but to move in unison.

In some embodiments, the waterproof expansion joint 900 can include a layer of bond breaker 1070 to prevent portions of the waterproof expansion joint 900 from bonding to one another and allowing portions of the waterproof expansion joint 900 to slide relative to one another. In some embodiments, the waterproof expansion joint 900 can include a layer of bond breaker 1070 on top of the ballast protection plate 860. The bond breaker 1070 can be installed in a variety of methods which may include, pouring, rolling, spraying, application of preformed strips, etc. In some embodiments, the bond breaker 1070 comprises a material which is not chemically compatible with other portions of the waterproof expansion joint 900.

In some embodiments, the waterproof expansion joint 900 can include an outer waterproof membrane 1080 installed over the ballast protection plate 860. In some embodiments, a bond breaker 1070 is installed between the ballast protection plate 860 and the outer waterproof membrane 1080. In some embodiments, the outer waterproof membrane 1080 is similar to other waterproof membranes discussed herein. In some embodiments, the bond breaker 1070 is similar other bond breakers discussed herein. In some embodiments, the outer waterproof membrane 1080 extends past the end of the ballast protection plate 860 and is also installed over at least a portion of the girder 112. In some embodiments the outer waterproof membrane 1080 can be adhered to the girder 112. In some embodiments, the outer waterproof membrane 1080 can be adhered to another layer of waterproof membrane 900. In some embodiments, the outer waterproof membrane 1080 can also be installed over at least one locating device 820. In some embodiments, the outer waterproof membrane 1080 can be installed to substantially encompass the rest of the waterproof expansion joint 900, inhibiting water from contacting the rest of the waterproof expansion joint. In some embodiments, the outer waterproof membrane 1080 can be installed to substantially cover the rest of the waterproof expansion joint 900. In some embodiments, the outer waterproof membrane 1080 can comprise a monolithic layer over the bridge deck which does not include seams. In some embodiments, the outer waterproof membrane 1080 can inhibit water from falling through the deck joint 114. In some embodiments, the outer waterproof membrane 1080 can inhibit water from coming into contact with the ballast protection plate 860, preventing corrosion. In some embodiments, the outer waterproof membrane 1080 can inhibit water from coming into contact with at least one locating device 820.

In some embodiments, different configurations of the layers of the waterproof expansion joint 900 than that illustrated in FIG. 10 are possible. In some embodiments, the waterproof expansion joint 900 can include fewer layers or additional layers. In some embodiments, the layers can be stacked in a different order. In some embodiments, different portions of the waterproof expansion joint 900 can include different configurations.

Figure 11:
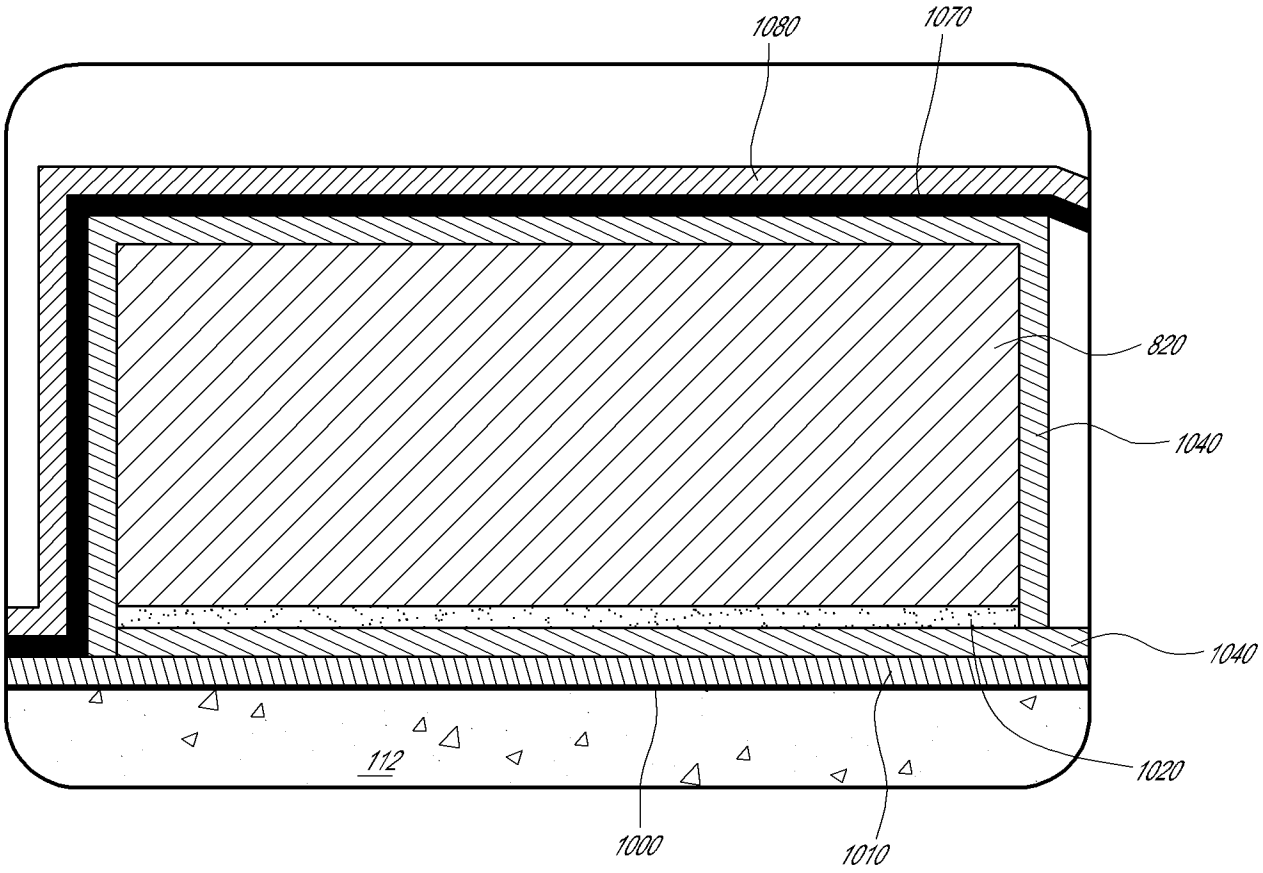
FIG. 11 is a cross-sectional detail view of one embodiment of a locating device of a waterproof expansion joint.

FIG. 11 is a cross-sectional detail view of one embodiment of a locating device 820 of a waterproof expansion joint 900. In some embodiments, the waterproof expansion joint 900 can include at least one locating device 820 as discussed above. In some embodiments, the locating device 820 can comprise a plate end guide as illustrated in FIG. 11. In some embodiments, the locating device 820 can be installed and adhered to the girder 112 below it. In some embodiments, the locating device can be installed on a bridge deck waterproof membrane 1010 as illustrated in FIG. 11. In some embodiments, the adhesive layer 1020 can be installed on the bridge deck waterproof membrane 1010 and the locating device 820 installed on top of the adhesive layer 1020 to bond the locating device 820 to the bridge deck waterproof membrane 1010 and restrict movement of the locating device 820 relative to the girder 112. In some embodiments, the waterproof expansion joint 900 incorporates multiple layers of waterproof membrane 110, 1010, 1040, 1080. In some embodiments, the layers of waterproof membrane 110, 1010, 1040, 1080 described herein comprise the same materials and construction techniques, but are referred to with different names, which may include for example, waterproof membrane 110, 1040, bridge deck waterproof membrane 1010, outer waterproof membrane 1080, in order to facilitate ease of reference when describing the orientation and construction of the waterproof expansion joint, however each layer is interchangeable with one another.

In some embodiments, the locating device 820 can include a layer of waterproof membrane 1040 installed over the exterior of the locating device 820 to inhibit water from reaching the locating device 820. In some embodiments, the locating device 820 comprises a material compatible with the waterproof membrane 1040, allowing it to be bonded to the waterproof membrane 1040. In some embodiments, as discussed above, an outer waterproof membrane 1080 can also be installed over the top of the locating device 820. In some embodiments, the locating device 820 can have a layer of bond breaker 1070 installed so that the outer waterproof membrane 1080 is able to move and stretch relative to the locating device 820. The bond breaker 1070 allows the outer waterproof membrane 1080 to stretch along its width if the width of the deck joint 114 should change rather than constraining the portion of the outer waterproof membrane 1080 allowed to stretch to a smaller portion of the outer waterproof membrane 1080, thus requiring a more flexible membrane and possibly impacting the structural integrity of the outer waterproof membrane 1080.

In some embodiments, different portions of the waterproof expansion joint 900 can comprise materials compatible with one another, allowing them to be chemically bonded together, forming a seal inhibiting the entry of water. These portions can include for example, waterproof membranes 110, 1010, 1040, 1080, primers 1000, adhesive layers 1020, flexible sealing members 830, joint support plates 950, ballast protection plates 860, locating devices 820, etc. In some embodiments, different portions of the waterproof expansion joint 900 can comprise the same material, which may include for example, an elastomer, a polymer, epoxy, urethane, fiberglass, carbon fiber, polyurea, etc. In some embodiments, when bonded together, the different portions of the waterproof expansion joint 900 can comprise a monolithic structure, inhibiting the entry of water. In some embodiments, portions of the waterproof expansion joint 900 may not be chemically compatible with other portions of the joint and may require the use of a primer 1000 or an intermediary member such as the joint support plate 950 to achieve strong adhesion and a waterproof seal. In some embodiments, portions of the waterproof expansion joint 900 which traditionally aren't chemically compatible with other portions of the waterproof expansion joint 900, may be substituted by an equivalent structure which is chemically compatible with other portions of the waterproof expansion joint 900. In some embodiments, such substitutions may negate the need for some of the features discussed above. In some embodiments, some portions of the waterproof expansion joint, such as the locating devices 820 or the ballast protection plate 860, can comprise a composite material. In some embodiments, the composite material can comprise any one of or a combination of a variety of materials which can include for example, an elastomer, a polymer, epoxy, urethane, fiberglass, carbon fiber, polyurea, etc. In some embodiments, portions of the waterproof expansion joint 900 can comprise more traditional materials such as steel.

The foregoing description details certain embodiments. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A waterproof expansion joint for use on a deck joint defined by at least two girders, the waterproof expansion joint comprising:

a ballast protection plate dimensioned such that when installed over a deck joint the ballast protection plate inhibits ballast from falling into a deck joint;

at least one locating device positioned with respect to the ballast protection plate such that the locating device limits lateral movement of the ballast protection plate with respect to the deck joint;

a flexible sealing member dimensioned to be installed below the ballast protection plate and span the deck joint;

wherein the flexible sealing member comprises at least one flange portion, each flange portion dimensioned to be attached to girders;

wherein the at least one locating device comprises at least one centering tab and wherein each centering tab protrudes into a recess in the flexible sealing member formed by the at least one expansion feature.

2. The waterproof expansion joint of claim 1, further comprising a plurality of expansion features.

3. The waterproof expansion joint of claim 2, wherein said plurality of expansion features comprises expansion features of different sizes.

4. The waterproof expansion joint of claim 3, wherein the plurality of expansion features comprises a "V" shape, wherein the angle formed by the "V" shape can change depending on the width of the deck joint.

5. The waterproof expansion joint of claim 1, wherein each flange portion is located on a top surface of each girder, wherein the waterproof expansion joint further comprises a bridge deck waterproof membrane applied to the top of the girders and located below each flange portion, and wherein each flange portion is attached to the bridge deck waterproof membrane with an adhesive layer.

6. The waterproof expansion joint of claim 5, further comprising an outer waterproof membrane substantially covering the rest of the waterproof expansion joint.

7. The waterproof expansion joint of claim 6, further comprising a bond breaker layer between the ballast protection plate and the outer waterproof membrane, such that the bond breaker allows the ballast protection plate to move relative to the outer waterproof membrane.

8. The waterproof expansion joint of claim 5, further comprising a primer wherein the primer is applied to the girders and promotes adhesion of either the bridge deck waterproof membrane or the flexible seal member to the girders.

9. The waterproof expansion joint of claim 2, further comprising a joint support plate configured to span the deck joint and be installed below the ballast protection plate, wherein a portion of the flexible sealing member located between the girders is attached to a bottom side of the joint support plate.

10. The waterproof expansion joint of claim 1, wherein the at least one locating device comprises at least one plate end guide, wherein the at least one plate end guide comprises at least one elongate member located on top of the girder and spaced a distance from the edge of the ballast protection plate large enough to allow for variation in the width of the deck joint but not large enough to allow the ballast protection plate to fall through the deck joint.

11. The waterproof expansion joint of claim 2, wherein a portion of the flexible sealing member located between the girders is attached to a bottom side of the ballast protection plate.

12. The waterproof expansion joint of claim 5, wherein the flexible sealing member, adhesive layers, and waterproof membranes are chemically compatible with one another.

13. The waterproof expansion joint of claim 12, wherein the flexible sealing member, adhesive layer, and waterproof membranes comprise polyurea.

14. The waterproof expansion joint of claim 12, wherein portions of the waterproof expansion joint form a monolithic structure once bonded together inhibiting the entry of water into the waterproof expansion joint.

15. A waterproof expansion joint for use on a deck joint defined by at least two girders, the waterproof expansion joint comprising:

a ballast protection plate dimensioned such that when installed over a deck joint the ballast protection plate inhibits ballast from falling into a deck joint;

at least one locating device positioned with respect to the ballast protection plate such that the locating device limits lateral movement of the ballast protection plate with respect to the deck joint;

a flexible sealing member dimensioned to be installed below the ballast protection plate and span the deck joint;

wherein the flexible sealing member comprises at least one flange portion, each flange portion dimensioned to be attached to girders; and wherein the at least one locating device comprises at least one plate end guide, wherein the at least one plate end guide comprises at least one elongate member located on top of the girder and spaced a distance from the edge of the ballast protection plate large enough to allow for variation in the width of the deck joint but not large enough to allow the ballast protection plate to fall through the deck joint.

16. A waterproof expansion joint for use on a deck joint defined by at least two girders, the waterproof expansion joint comprising:

a ballast protection plate dimensioned such that when installed over a deck joint the ballast protection plate inhibits ballast from falling into a deck joint;

at least one locating device positioned with respect to the ballast protection plate such that the locating device limits lateral movement of the ballast protection plate with respect to the deck joint;

a flexible sealing member dimensioned to be installed below the ballast protection plate and span the deck joint;

wherein the flexible sealing member comprises at least one flange portion, each flange portion dimensioned to be attached to girders wherein the at least one flange portion is located on a top surface of each girder;

a bridge deck waterproof membrane applied to the top of the girders and located below each flange portion, and wherein each flange portion is attached to the bridge deck waterproof membrane with an adhesive layer;

an outer waterproof membrane substantially covering the rest of the waterproof expansion joint; and a bond breaker layer between the ballast protection plate and the outer waterproof membrane, such that the bond breaker allows the ballast protection plate to move relative to the outer waterproof membrane.

* * * * *